US006536637B1

(12) United States Patent
McLaughlin

(10) Patent No.: US 6,536,637 B1
(45) Date of Patent: Mar. 25, 2003

(54) COMBINATION BACKPACK AND WATER CONTAINER

(76) Inventor: Marty E. McLaughlin, 6321 Milgren Rd. #3, Columbus, GA (US) 31907

( * ) Notice: Subject to any disclaimer, the term of this patent is extended or adjusted under 35 U.S.C. 154(b) by 0 days.

(21) Appl. No.: 09/810,066

(22) Filed: Mar. 16, 2001

(51) Int. Cl.[7] ..... A45F 3/16

(52) U.S. Cl. ..... 224/148.3; 224/148.1; 224/148.4; 224/148.7; 224/153

(58) Field of Search ..... 224/148.3, 148.1, 224/148.4, 148.5, 148.6, 148.7, 153

(56) References Cited

U.S. PATENT DOCUMENTS

| | | | | | |
|---|---|---|---|---|---|
| 357,272 | A | | 2/1887 | Donavin | |
| 2,013,358 | A | * | 9/1935 | Osborne | 169/30 |
| 3,980,216 | A | | 9/1976 | Nye | |
| 4,420,097 | A | * | 12/1983 | Motsenbocker | 222/131 |
| 4,673,117 | A | * | 6/1987 | Calton | 224/148.3 |
| 4,721,237 | A | | 1/1988 | Leslie | |
| 4,921,143 | A | * | 5/1990 | Billet | 224/148.3 |
| 4,940,173 | A | * | 7/1990 | Jacober | 224/153 |
| D340,351 | S | | 10/1993 | Wrath | |
| 5,465,885 | A | * | 11/1995 | Wyatt | 222/175 |
| 5,509,279 | A | | 4/1996 | Brown et al. | |
| 5,803,333 | A | * | 9/1998 | Fawcett | 224/148.2 |
| 5,975,387 | A | * | 11/1999 | Gleason et al. | 224/148.2 |
| 6,305,587 | B1 | * | 10/2001 | Miller | 224/153 |
| 6,422,439 | B1 | * | 7/2002 | Kelliher et al. | 224/148.2 |

* cited by examiner

*Primary Examiner*—Stephen K. Cronin
*Assistant Examiner*—Maerena W. Brevard

(57) ABSTRACT

A combination backpack and cooler for transporting consumables on the back of a user. The combination backpack and cooler includes a main body portion having a front panel, a back panel, a pair of side panels, a top panel and a bottom panel. One of the side panels has an aperture extending therethrough. Each of a pair of straps has a first end coupled the top and a second end coupled the bottom. A container is located in the main body. The container has a spout fluidly coupled thereto and positioned for extending through the aperture in the main body. A cover member is adapted for frictionally engaging an edge of an opening of the spout for closing the spout.

9 Claims, 1 Drawing Sheet

COMBINATION BACKPACK AND WATER CONTAINER

BACKGROUND OF THE INVENTION

1. Field of the Invention

The present invention relates to backpack devices and more particularly pertains to a new combination backpack and water container for transporting a water container on the back of a user.

2. Description of the Prior Art

The use of backpack devices is known in the prior art. More specifically, backpack devices heretofore devised and utilized are known to consist basically of familiar, expected and obvious structural configurations, notwithstanding the myriad of designs encompassed by the crowded prior art which have been developed for the fulfillment of countless objectives and requirements.

Known prior art includes U.S. Pat. Nos. 4,673,117; 5,509,279; U.S. Des. Pat. No. 340,351; U.S. Pat. Nos. 3,980,216; 357,272; and 4,721,237.

While these devices fulfill their respective, particular objectives and requirements, the aforementioned patents do not disclose a new combination backpack and water container. The inventive device includes a backpack including a main body portion having a front panel, a back panel, a pair of side panels, a top panel and a bottom panel. One of the side panels has an aperture extending therethrough. Each of a pair of straps has a first end coupled to a juncture of the top and back panels and a second end coupled to a juncture of the bottom and back panels. A container for holding a liquid is located in the main body. The container has a spout fluidly coupled thereto and positioned for extending through the aperture in the main body. A cover member is adapted for frictionally engaging an edge of an opening of the spout for closing the spout.

In these respects, the combination backpack and water container according to the present invention substantially departs from the conventional concepts and designs of the prior art, and in so doing provides an apparatus primarily developed for the purpose of transporting a water container on the back of a user.

SUMMARY OF THE INVENTION

In view of the foregoing disadvantages inherent in the known types of backpack devices now present in the prior art, the present invention provides a new combination backpack and water container construction wherein the same can be utilized for transporting a water container on the back of a user.

The general purpose of the present invention, which will be described subsequently in greater detail, is to provide a new combination backpack and water container apparatus and method which has many of the advantages of the backpack devices mentioned heretofore and many novel features that result in a new combination backpack and water container which is not anticipated, rendered obvious, suggested, or even implied by any of the prior art backpack devices, either alone or in any combination thereof.

To attain this, the present invention generally comprises a backpack including a main body portion having a front panel, a back panel, a pair of side panels, a top panel and a bottom panel. One of the side panels has an aperture extending therethrough. Each of a pair of straps has a first end coupled to a juncture of the top and back panels and a second end coupled to a juncture of the bottom and back panels. A container for holding a liquid is located in the main body. The container has a spout fluidly coupled thereto and positioned for extending through the aperture in the main body. A cover member is adapted for frictionally engaging an edge of an opening of the spout for closing the spout.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions in so far as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new combination backpack and water container apparatus and method which has many of the advantages of the backpack devices mentioned heretofore and many novel features that result in a new combination backpack and water container which is not anticipated, rendered obvious, suggested, or even implied by any of the prior art backpack devices, either alone or in any combination thereof.

It is another object of the present invention to provide a new combination backpack and water container which may be easily and efficiently manufactured and marketed.

It is a further object of the present invention to provide a new combination backpack and water container which is of a durable and reliable construction.

An even further object of the present invention is to provide a new combination backpack and water container which is susceptible of a low cost of manufacture with regard to both materials and labor, and which accordingly is then susceptible of low prices of sale to the consuming public, thereby making such combination backpack and water container economically available to the buying public.

Still yet another object of the present invention is to provide a new combination backpack and water container which provides in the apparatuses and methods of the prior art some of the advantages thereof, while simultaneously overcoming some of the disadvantages normally associated therewith.

Still another object of the present invention is to provide a new combination backpack and water container for transporting a water container on the back of a user.

Yet another object of the present invention is to provide a new combination backpack and water container which includes a backpack including a main body portion having a front panel, a back panel, a pair of side panels, a top panel and a bottom panel. One of the side panels has an aperture extending therethrough. Each of a pair of straps has a first end coupled to a juncture of the top and back panels and a second end coupled to a juncture of the bottom and back panels. A container for holding a liquid is located in the main body. The container has a spout fluidly coupled thereto and positioned for extending through the aperture in the main body. A cover member is adapted for frictionally engaging an edge of an opening of the spout for closing the spout.

Still yet another object of the present invention is to provide a new combination backpack and water container that allows a person carrying a backpack to also have an insulated water container contained therein.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
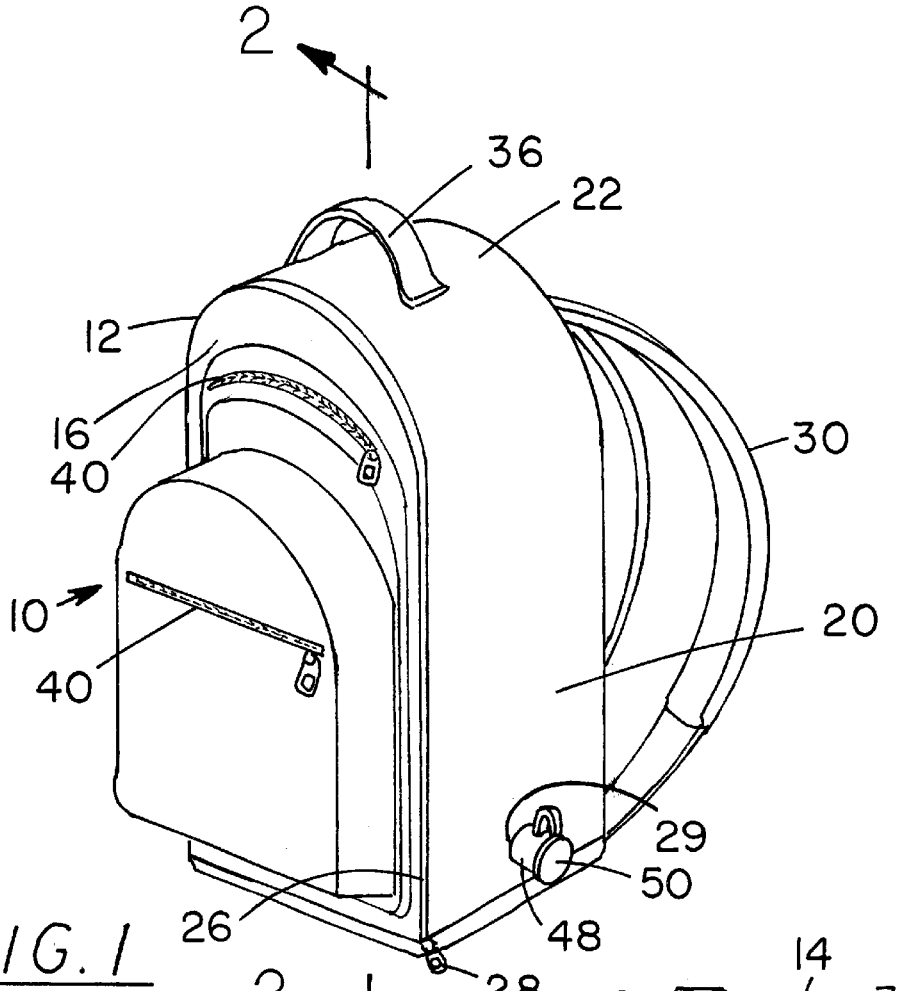
FIG. 1 is a schematic perspective view of a new combination backpack and water container according to the present invention.
Figure 2:
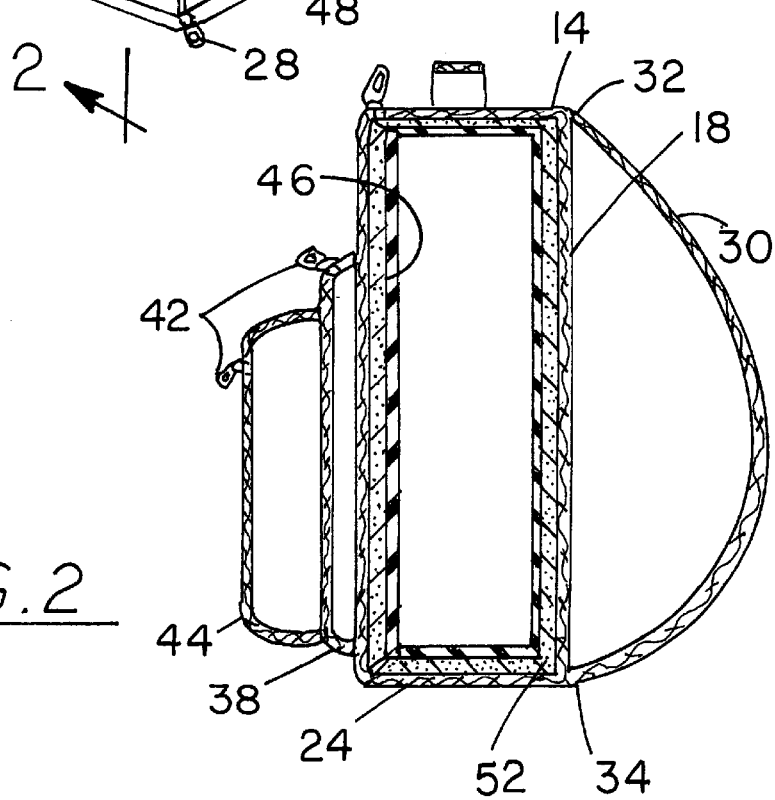
FIG. 2 is a schematic cross-sectional view taken along line 2—2 of FIG. 1 of the present invention.

With reference now to the drawings, and in particular to FIGS. 1 and 2 thereof, a new combination backpack and cooler embodying the principles and concepts of the present invention and generally designated by the reference numeral 10 will be described.

As best illustrated in FIGS. 1 and 2, the combination backpack and cooler 10 generally comprises a backpack 12 including a main body portion 14 having a front panel 16, a back panel 18, a pair of side panels 20, a top panel 22 and a bottom panel 24. The main body portion 14 has an opening 26 therein extending along a juncture of one of the side panels 20 and the front panel 16. A fastening member 28 selectively closes the opening and comprises a zipper. One of the side panels 20 has an aperture 29 extending therethrough. The aperture 29 is positioned generally adjacent to the bottom panel 24.

Each of a pair of straps 30 has a first end 32 coupled to a juncture of the top 22 and back 18 panels and a second end 34 coupled to a juncture of the bottom 24 and back 18 panels.

A handle member 36 is attached to the top panel 22. The handle member 36 comprises an elongated member having a pair of ends each attached to the top wall.

A first compartment 38 is attached to the front panel 16. The first compartment 38 has an elongated slot 40 therein for accessing an interior of the first compartment. A fastener 42 selectively opens or closes the elongated slot. The fastener 42 comprises a zipper attached to opposite edges of the elongated slot 40.

A second compartment 44 is attached to the first compartment 38. The second compartment 44 has an elongated slot 40 therein for accessing an interior of the second compartment 44. A fastener 42 selectively opens or closes the elongated slot 40 in the second compartment 44. The fastener 42 comprises a zipper attached to opposite edges of the elongated slot 40 in the second compartment 44.

A container 46 for holding consumables is located in the main body 14. The container 46 has a spout 48 environmental coupled thereto and extending through the aperture 29 in the main body 14. A cover member 50 is adapted for frictionally engaging an edge of an opening of the spout 48 for closing the spout 48.

An insulating material 52 is positioned between the container 46 and the panels of the main body portion 14. The insulating material 52 resists the transfer of heat through the backpack 12 and the container 46.

In a preferred embodiment the container 46 is constructed primarily of the insulating material 52 to form a liner member which is designed for receiving ice to keep consumables (food and beverages) cold. As the ice melts, the cover member 50 may be removed from the spout 48 to drain off excess water from the melted ice.

In use, the device 10 is used as a conventional backpack having compartments therein for storing various articles. The container 46 may be filled with food and drink for consumption while resisting heat gain or loss.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly arid use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A cooler and backpack combination device, comprising: a backpack including;

a main body portion having a front panel, a back panel, a pair of side panels, a top panel and a bottom panel, one of said side panels having an aperture extending therethrough;

a pair of straps, each of said straps having a first end coupled to a juncture of said top and back panels and a second end coupled to a juncture of said bottom and back panels;

a container for holding consumables located in said main body, said container having a spout fluidly coupled thereto and positioned for extending through said aperture in said main body, a cover member being adapted for frictionally engaging an edge of an opening of said spout for closing said spout;

said main body portion has an opening therein extending along a juncture of one of said side panels and said front panel, a fastening member selectively closes said opening and comprises a zipper, said zipper facilitating access into an interior of said container;

an insulating material being positioned between said container and said panels of said main body portion.

2. The cooler and backpack combination device as in claim 1, wherein said backpack further includes:

a handle member being attached to said top panel, said handle member comprising an elongated member having a pair of ends each being attached to said top wall.

3. The cooler and backpack combination device as in claim 1, wherein said backpack further includes:

a compartment being attached to said front panel, said compartment having an elongated slot therein for accessing an interior of said compartment, a fastener selectively opens or closes said elongated slot, said fastener comprising a zipper being attached to opposite edges of said elongated slot.

4. A cooler and backpack combination device, comprising: a backpack including;

a main body portion having a front panel, a back panel, a pair of side panels, a top panel and a bottom panel, said main body portion having an opening therein extending along juncture of one of said side panels and said front panel, a fastening member selectively closes said opening and comprises a zipper, one of said side panels having an aperture extending therethrough, said aperture being positioned generally adjacent to said bottom panel;

a pair of straps, each of said straps having a first end coupled to a juncture of said top and back panels and a second end coupled to a juncture of said bottom and back panels;

a handle member being attached to said top panel, said handle member comprising an elongated member having a pair of ends each being attached to said top wall;

a first compartment being attached to said front panel, said first compartment having an elongated slot therein for accessing an interior of said first compartment, a fastener selectively opens or closes said elongated slot, said fastener comprising a zipper being attached to opposite edges of said elongated slot;

a second compartment being attached to said first compartment, said second compartment having an elongated slot therein for accessing an interior of said second compartment, a fastener selectively opens or closes said elongated slot in said second compartment, said fastener comprising a zipper being attached to opposite edges of said elongated slot in said second compartment;

a container being located in said main body, said container having a spout fluidly coupled thereto and extending through said aperture in said main body, a cover member being adapted for frictionally engaging an edge of an opening of said spout for closing said spout; and an insulating material being positioned between said container and said panels of said main body portion.

5. A cooler and backpack combination devices comprising:

a main body portion defining an interior space, said main body portion having an opening facilitating access to said interior space;

a liner member positioned within said interior space; and at least one strap member coupled to said main body portion, said strap member facilitating transport of said main body portion by a user; and a second compartment being attached to said first compartment, said second compartment having an elongated slot therein for accessing an interior of said second compartment, a fastener selectively opens or closes said elongated slot in said second compartment, said fastener comprising a zipper being attached to opposite edges of said elongated slot in said second compartment.

6. The device of claim 5, further comprising a handle member operationally coupled to said main body portion, said handle member being for facilitating moving and picking up said main body portion.

7. The device of claim 5, further comprising:

wherein said liner member having a first aperture extending therethrough, said main body portion having a second aperture extending therethrough;

a spout member extending through said first and second apertures such that said spout member facilitates environmental communication between said interior portion and an environment external to said main body portion, said spout member facilitating draining said interior space.

8. The device of claim 7, further comprising a cover member couplable to said spout member, said cover member being for selectively closing said spout member for inhibiting environmental communication.

9. The device of claim 5, further comprising a first compartment being attached to said front panel, said first compartment having an elongated slot therein for accessing an interior of said first compartment, a fastener selectively opens or closes said elongated slot, said fastener comprising a zipper being attached to opposite edges of said elongated slot.

* * * * *